United States Patent [19]

Muzslay

[11] Patent Number: 4,950,171

[45] Date of Patent: Aug. 21, 1990

[54] FUEL INJECTOR CONNECTOR SYSTEM

[75] Inventor: Steven Z. Muzslay, Huntington Beach, Calif.

[73] Assignee: ITT Corporation, New York, N.Y.

[21] Appl. No.: 392,324

[22] Filed: Aug. 11, 1989

[51] Int. Cl.[5] ..... H01R 9/09

[52] U.S. Cl. ..... 439/76; 439/77; 439/82; 439/130; 439/271; 123/456; 123/470; 361/398

[58] Field of Search ..... 123/456, 470, 472; 361/398; 285/95; 439/55, 67, 76, 77, 78, 81, 82, 83, 271, 130, 34

[56] References Cited

U.S. PATENT DOCUMENTS

| | | | |
|---|---|---|---|
| 3,340,608 | 9/1967 | Blair et al. | 29/626 |
| 3,617,980 | 11/1971 | Alkire et al. | 439/629 X |
| 3,746,348 | 7/1973 | Stone | 285/95 |
| 3,915,544 | 10/1975 | Yurtin | 439/77 X |
| 4,072,377 | 2/1978 | Van de Loo et al. | 439/77 X |
| 4,144,705 | 3/1979 | Iinuma | 58/52 |
| 4,149,220 | 4/1979 | Crall et al. | 361/395 |
| 4,193,659 | 3/1980 | Deverrewaere | 439/77 X |
| 4,355,853 | 10/1982 | Kourimsky | 439/76 X |
| 4,385,791 | 5/1983 | Lovrenich | 439/83 |
| 4,390,219 | 6/1983 | Beehler | 439/76 X |
| 4,503,611 | 3/1985 | Sampson et al. | 29/845 |
| 4,557,225 | 12/1985 | Sagues et al. | 123/41.31 |
| 4,570,600 | 2/1986 | Atkins et al. | 123/456 X |
| 4,636,920 | 1/1987 | Cook et al. | 361/420 |
| 4,639,059 | 1/1987 | Thepault | 439/77 |
| 4,702,202 | 10/1987 | Hensel et al. | 123/456 X |
| 4,702,708 | 10/1987 | Reuss et al. | 439/83 |
| 4,758,167 | 7/1988 | Bepoix | 439/49 |
| 4,811,165 | 3/1989 | Currier et al. | 361/398 X |
| 4,842,540 | 6/1989 | Endo et al. | 439/271 |
| 4,844,036 | 7/1989 | Bassler et al. | 123/470 |
| 4,857,003 | 8/1989 | Hafner et al. | 439/130 |

FOREIGN PATENT DOCUMENTS

| | | | |
|---|---|---|---|
| 0864657 | 4/1961 | United Kingdom | 439/83 |

OTHER PUBLICATIONS

IBM Bulletin, vol. 14, No. 9, Kryzaniwsky, 2-1972.
IBM Bulletin, Skinner, 8-1969.

*Primary Examiner*—Neil Abrams
*Assistant Examiner*—Khiem Nguyen
*Attorney, Agent, or Firm*—Thomas L. Peterson

[57] ABSTRACT

A system is described for use with fuel injectors mounted on fuel rails of an engine, to connect the output lines of an electrical circuit to the fuel injectors, which provide an orderly and reliable connection. The system includes a connector assembly with a printed circuit board sandwiched between upper and lower molded housing parts. The circuit board has pairs of contacts at each injector location for mating with the fuel injector contacts, and the circuit board has conductors thereon leading from a connector end portion to the pairs of contacts. In an assembly where the connector end portion extends largely perpendicular to the rest of the assembly, a flexible circuit board is provided which is held in a bend by correspondingly angled upper and lower housing parts. In an assembly where the axes of the fuel injectors do not extend perpendicular to the length of the fuel rail, the lower housing part has several face locations angled from the length direction of the board. Each face location has a face seal with an hourglass cross section. Each circuit board terminal includes a flange resting against a conductive pad on the circuit board, a base extending through the circuit board, and fingers extending beyond the circuit board.

6 Claims, 4 Drawing Sheets

FUEL INJECTOR CONNECTOR SYSTEM

BACKGROUND OF THE INVENTION

Vehicles with fuel injection engines commonly include a fuel rail extending along the top of the engine block and carrying a fuel injector for each power cylinder. Each fuel injector has a pair of contacts lying above the fuel rail, to which electrical signals are delivered that operate a plunger that allows the pressured fuel to be briefly injected into the cylinder. The electrical signals that control each fuel injector are generated by a circuit with several output lines carrying signals. The present practice is to use flexible cable assemblies with many wires connecting the circuit to the contacts of the different fuel injectors. The numerous connections and long flexible wires reduce reliability, get in the way of mechanics servicing the engine, and create a "messy" appearance. Apparatus that provided for interconnection of the injector control circuit to the numerous contacts of a group of fuel injectors, in a rapid, neat and reliable manner, would be of considerable value.

SUMMARY OF THE INVENTION

In accordance with one embodiment of the present invention, an apparatus is provided for coupling a circuit that generate fuel injector controlling signals to a plurality of fuel injectors, which is reliable and which makes the connections in an orderly manner. The apparatus includes a circuit board sandwiched between upper and lower molded parts to form a connector assembly with an input portion connected to the injector control circuit. The connector assembly also includes an elongated output portion with injector-connecting locations spaced therealong. The printed circuit board has a pair of contacts at each injector-connecting location, which are connected by printed circuit conductors to the connector location.

In one apparatus, the portion of the circuit board at the input portion extends perpendicular to the output portion that has the injector-connecting locations. The circuit board is flexible and the molded housing parts are used to form and hold the circuit board in its curved configuration. In a connector assembly where the axes of the fuel injectors are not perpendicular to the length of the fuel rail and the connector assembly, the connector assembly has a plurality of separate faces at the injector-connecting location that are angled from the length direction of the output portion. A face seal which seals the upper end of each fuel injector to the connector assembly, includes an elastomeric ring whose cross section is somewhat is in the shape of an hourglass, in that it has a greater height than width and its upper portion has protruding sides in interference fit with the groove that holds the seal. Each of a pair of contacts on the circuit board at each injector-connecting location, is a stamped sheet metal part having a flange on the underside of the circuit board, a base that projects through the circuit board, and a plurality of fingers extending above the circuit board.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
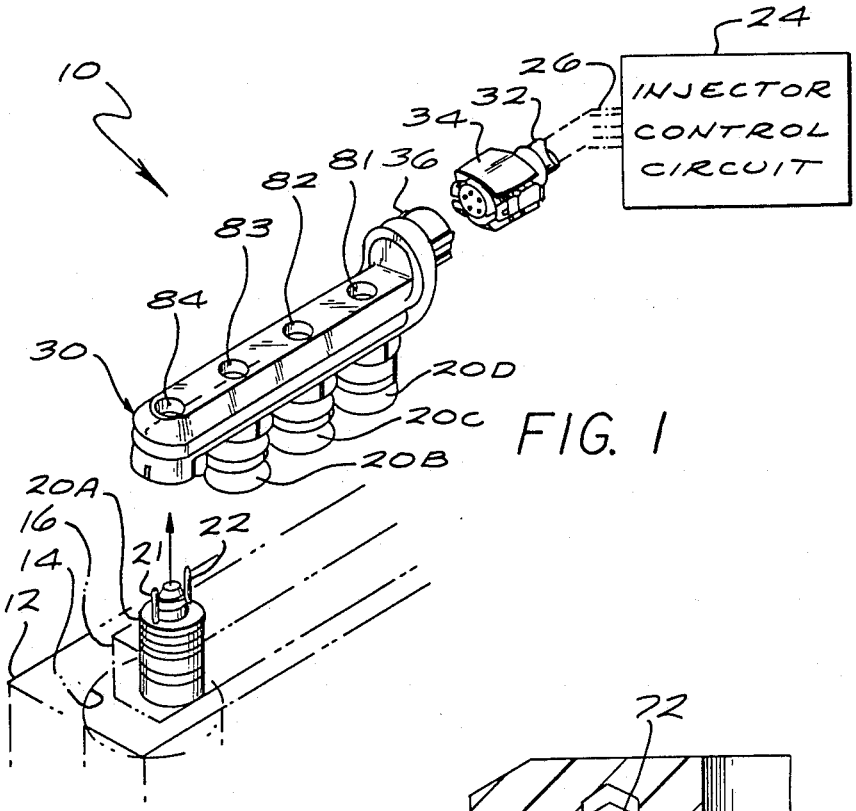
FIG. 1 is an exploded perspective view of a connector assembly of one embodiment of the present invention, shown with fuel injectors mounted on a fuel rail that is mounted on an engine block.

FIG. 1 illustrates a portion of a vehicle engine 10 which includes an engine block 12 containing power cylinders 14. A fuel injector rail 16 is mounted on the top of the engine and carries pressured liquid fuel such as gasoline. Fuel injectors 20A–20D are mounted on the rail. Each fuel injector has a pair of electrical contacts 21, 22 that receive electrical energy or signals that energize a solenoid in the fuel injector that injects fuel into the power cylinder. Such electrical signals are generated by an injector control circuit 24 whose output lines 26 must be connected to the different fuel injectors. In the prior art, separate wires connected the circuit output lines 26 to the fuel injector contacts 21, 22, which resulted in the presence of many flexible wires at the top of the engine. Such wires have the disadvantage that they interfere with maintenance of the engine, may be damaged especially during maintenance, and create a "messy" environment that encourages sloppiness in maintenance.

In accordance with the present invention, a connector assembly 30 is provided which couples the injector control circuit 24 to the contacts of the different fuel injectors 20A–20D. A single cable 32 connects the circuit output lines 26 to a circuit output connector 34 that connects to an input connector 36 of the connector assembly. The connector distributes the electrical signals to the contacts of the different injectors to operate them in a properly timed sequence.

Figure 3:
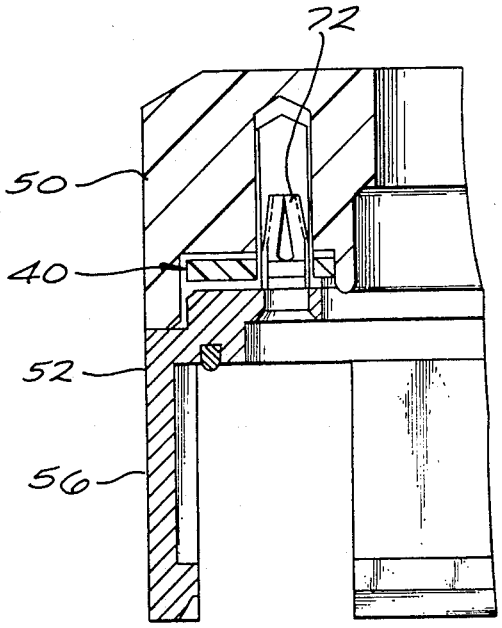
FIG. 3 is a partial sectional view of another end portion of the connector assembly of FIG. 1, without fuel injectors in place.
Figure 2:
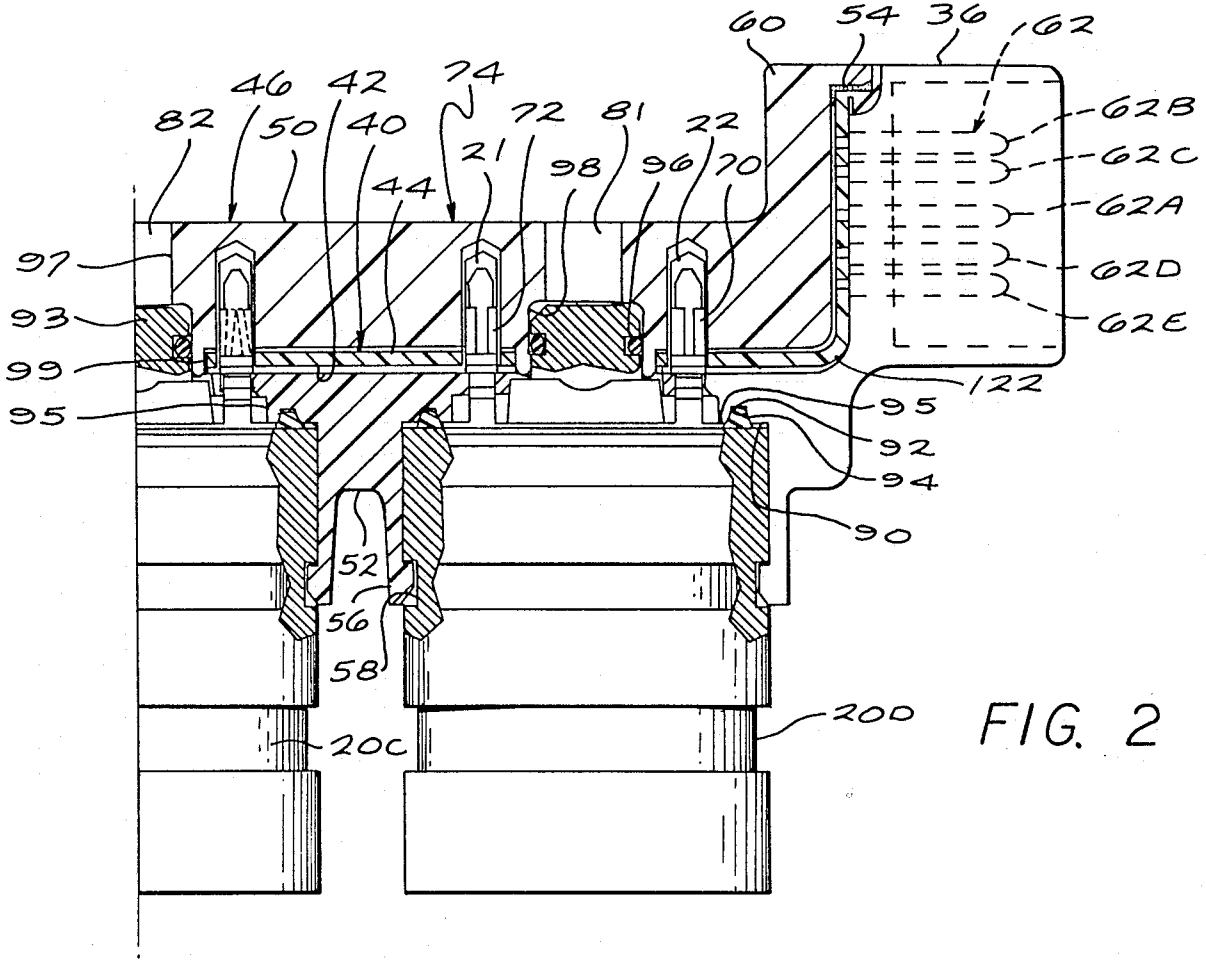
FIG. 2 is a partial sectional view of one end portion of the connector assembly of FIG. 1 with fuel injectors installed.

As illustrates in FIGS. 2 and 3, the connector assembly includes a printed circuit board 40 having a lower face 42 with printed circuit conductors thereon and an upper face 44. A housing 46 that surrounds the circuit board includes upper and lower housing parts 50, 52. The housing parts are joined by a permanent adhesive 54 that extends along the periphery of the housing and provides an environmental seal. The lower housing part has latches 56 that snap into grooves 58 in the fuel injectors to releasably join to the upper ends of the fuel injectors.

Figures 8, 9, 10:
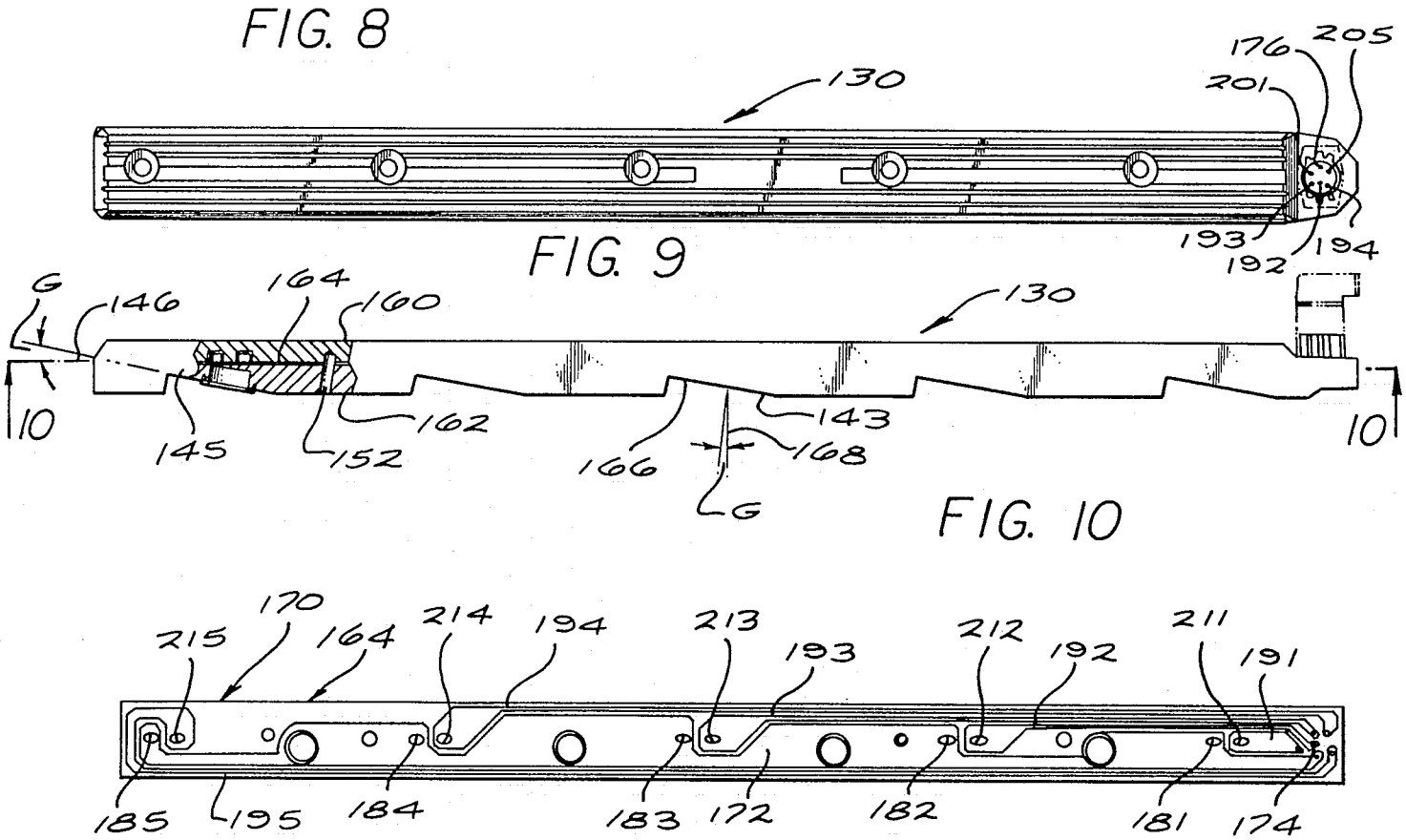
FIG. 8 is a plan view of the connector assembly of FIG. 7.
FIG. 9 is a partially sectional side view of the connector assembly of FIG. 8.
FIG. 10 is a view taken on the line 10—10 of FIG. 9, showing conductors of the circuit board of the connector assembly of FIG. 9.

The circuit board assembly includes an input connector end portion 60 forming the input connector 36. The connector includes several connector terminals 62, including a common ground or bus terminal 62A connected to the first contact 21 of each fuel injector, and additional terminals 62B–62E which are each connected to a second terminal 22 of a selected one of the four fuel injectors. Each terminal such as 62B is connected by a printed circuit conductor extending along a face of the circuit board 40 to a contact such as 70 of the printed circuit board or circuit board assembly. (FIG. 10 shows similar circuit board conductors of another embodiment of the invention.) The bus conductor extends from the ground terminal 62A to the first contact 72 that contacts to a corresponding fuel injector contact 21. The connector assembly includes an elongated output portion 74 extending away from the input connector 36, with the output portion having a plurality of injector-connecting locations 81–84 spaced along its length. The circuit board includes two contacts 70, 72 at each of the locations, as well as group of latches 56 for holding the body of a fuel injector, and means for sealing to the fuel injector.

Each injector location such as 81 includes an annular downwardly-facing flat face 90, with a groove 92 therein that holds a ring seal 94. The ring seal is used to seal the bottom of the area where electrical connections are made to the fuel injector contacts, by sealing to an upper face 95 of the fuel injector. The fuel injector carries a radial seal 96 in a protruding upper end 93 thereof that seals to a hole 98 in the upper housing part 46. The upper end 93 projects through aligned holes 95, 97 in the lower and upper housing parts and through an aligned hole 99 in the circuit board. Thus, the circuit board is sealed against the entry of corrosive fumes and the like, to assure long life for the fuel injector contacts 21–22 and the circuit board contacts 70, 72.

Figure 4:
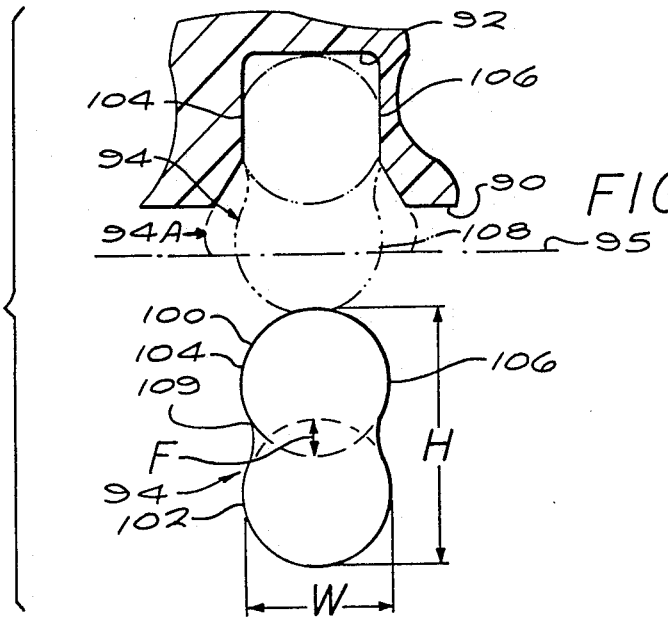
FIG. 4 is an enlarged exploded view of a portion of the connector assembly of FIG. 2, showing the seal arrangement thereof.

The connector assembly is manufactured in a factory and shipped with the face seals 94 installed. Radial seals such as the one shown at 96 of the top of fuel injector reliably hold themselves in place. However, the face seal 94 could drop out of the groove 92 during handling. To reduce the probability of such loss, applicant constructs the face seal as shown in FIG. 4, to help keep it in place during handling. The ring seal 94 has a greater height H than its width W, and has inner and outer parts 100, 102. The inner part has sidewardly protruding sides 104, 106 that lie in an interference fit with the sides of the groove 92 to help hold the seal in place in the groove. The bottom 108 of the seal outer part projects from the bottom of the groove until deflected into the groove to the configuration shown at 94A. Applicant prefers to construct the seal with the outside of its cross section, including parts of two circles with their outsides spaced a distance F of about one fourth the diameter of each circle, to leave a necked region 109. By providing an elongated seal of greater height H than width W, applicant places the interfering side parts 104, 106 of the seal deep within the groove, so even if the seal changes position slightly as when the connector is subjected to a moderate shock, the seal still will not fall out of the groove, and still a large portion of the seal projects below the face 90 to assure sealing even if the upper face of one fuel injector is slightly lower than the upper faces of the others.

Figure 5:
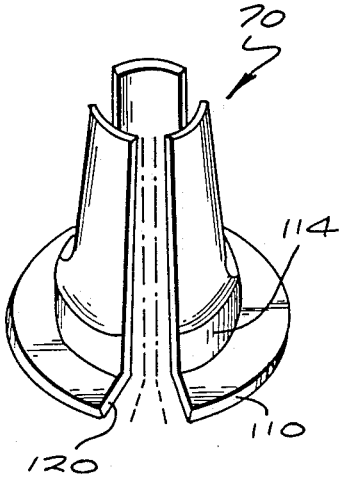
FIG. 5 is a perspective view of a contact of the connector assembly of FIG. 2.
Figure 6:
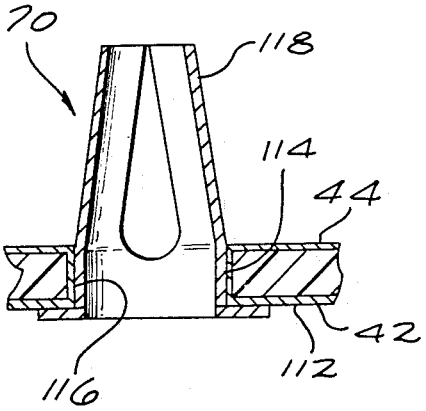
FIG. 6 is a sectional view of the connector of FIG. 5, showing it mounted on the circuit board of FIG. 3.

FIGS. 5 and 6 illustrate some details of the circuit board contact 70. Applicant constructs the contact 70 from a sheet of metal, with a flange 110 that rests against a conductive pad 112 at the lower face 42 of the circuit board, a base portion or base 114 that extends through a hole 116 in the circuit board, and a plurality of fingers 118 that extend upwardly from the upper face 44 of the board. The fingers 118 are resilient and can spread apart and together to make good electrical contact with the fuel injector contacts.

The contact 70 (FIG. 5) is formed with a gap 120 where the ends of the sheet metal lie spaced from each other. The diameter of the base portion 114 of the contact is initially greater than the diameter of the hole 116 into which it fits. However, the gap 120 can be closed so the base fits into the hole, and is held therein by friction due to the interference fit with the hole. This enables the contacts to be installed by merely pressing them up into place, with the contacts remaining in place until they are mechanically and electrically held in place as by dip solder, vapor phase, reflow, or other method.

Referring again to FIG. 2, it can be seen that the circuit board has a right angle bend at the location 122. Applicant uses a flexible circuit board, which is bent and held in a bent state by the upper and lower housing parts 50, 52 that substantially encapsulate it. In manufacturing, the circuit board is bent to approximately its final bent configuration, and is then placed between the molded housing parts 50, 52 which bend it and keep it bent in its final configuration.

Figure 7:
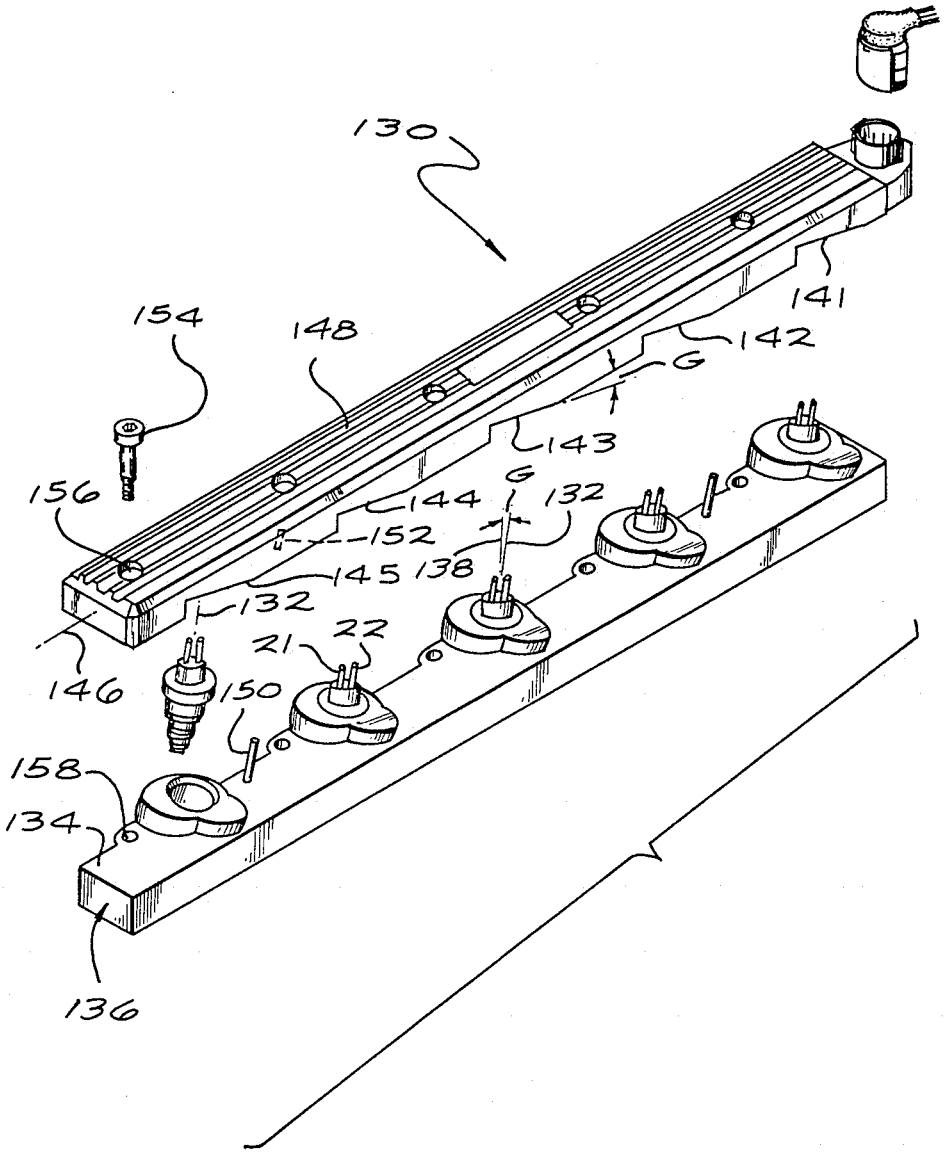
FIG. 7 is an exploded perspective view of a portion of another engine, and of a connector assembly constructed in accordance with another embodiment of the invention.

FIG. 7 illustrates another connector assembly 130 which is designed for use with an arrangement where the axis 132 of each fuel injector does not extend perpendicular to the upper surface 134 of the fuel rail 136 to which it is mounted, but extends at an angle G to a perpendicular line 138. The connector assembly 130 is similar to that of FIG. 2, except that its injector connecting locations 141–145 have faces that are angled by the angle G from the direction of elongation 146 of the elongated output portion 148 along which the connector locations are spaced. The connector is attached to the fuel rail 136 instead of only to the fuel injectors. To aid in engagement of the connector assembly with the fuel rail, the fuel rail is provided with guide pins 150 that fit into corresponding guide holes 152 in the connector assembly. When the connector assembly and rail have been brought together with their contacts mated, the screws such as 154 are installed through holes 156, 158 in the connector assembly and in the rail, to hold the parts together.

As shown in FIG. 9, the connector assembly 130 includes upper and lower housing parts 160, 162 and a printed circuit board 164 between them. Each injector location such as 143 has a lower face 166 extending at the angle G from a perpendicular line 168 that is perpendicular to the length direction 146 of most of the connector assembly. Each face 166 includes a face seal similar to that of FIG 4. Also, the circuit board has a pair of contacts at each injector location for connecting to the fuel injector contact 21, 22.

FIG. 10 illustrates the printed circuit 170 on the circuit board 164. The circuit includes a ground or bus conductor 172 formed as a usual printed circuit board conductor (a thin film or foil adhering facewise to an insulative board), and extends from an input terminal location 174 where it contacts an input terminal 176, to multiple holes 181–185 where the bus conductor connects to a circuit board contact. The circuit board also includes five signal conductors 191–195 that extend from other conductor terminals such as 201 and 205 to holes 211–215 that hold contacts.

Figure 11:
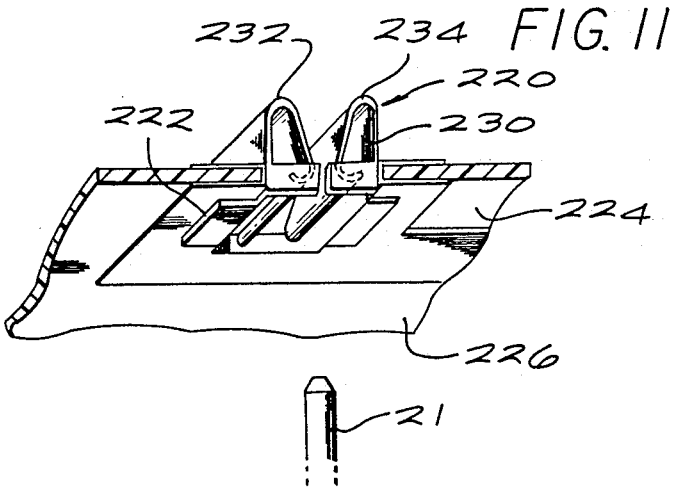
FIG. 11 is a partial perspective view of a portion of the circuit board of the connector assembly of FIG. 9, showing a contact thereof.
Figure 12:
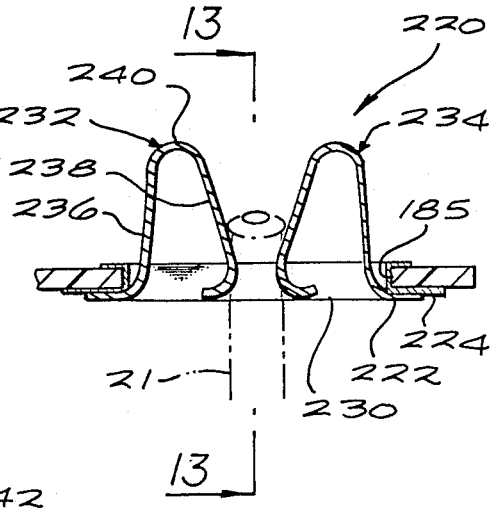
FIG. 12 is a sectional side view of the apparatus of FIG. 11.
Figure 13:
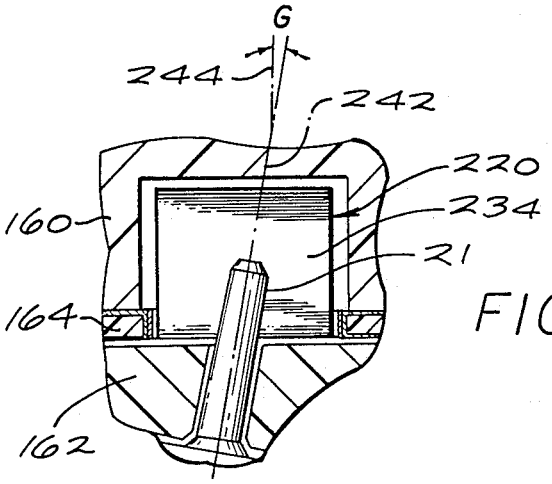
FIG. 13 is a sectional view taken on the line 13—13 of FIG. 12.

While the circuit board 164 extends along the length direction 146, and the axes of its holes extend perpendicular to the plane of the circuit board, the terminals 21, 22 of the fuel injectors extend at angles G from the axes of the circuit board holes. FIGS. 11–13 illustrate one of the contacts 220 that engages a fuel injector contact 21. The circuit board contact 220 is formed of sheet metal and includes a flange 222 lying facewise against a conductive pad 224 on the lower face 226 of the circuit board. The contact has a base 230 lying in the hole 185 in the circuit board, and has a pair of fingers 232, 234 with inner ends 236 extending away from the base and away from the flange and upwardly from the rest of the circuit board, and with outer ends 238 extending toward the base from a bend 240 of about 150°. The fingers 232, 234 can deflect to make contact with the fuel injector contact 21 despite the orientation of its axis 242 at an angle G of about 10° with the perpendicular direction 244 to the circuit board.

Thus, the invention provides a connector assembly for connecting a circuit that generates electrical signals controlling operation of a plurality of fuel injectors, to contacts on the fuel injectors, in a compact and orderly arrangement. The assembly includes a printed circuit board and a housing with upper and lower parts lying on opposite faces of the circuit board and trapping the circuit board between them to form an elongated sandwiched connector assembly. The connector assembly can connect to individual fuel injectors or to a fuel rail which holds them. The circuit board includes a printed circuit bus connector extending from a terminal to one contact of each pair of contacts on the circuit board. The circuit board also includes individual signal conductors connecting the other terminals to selected ones of the other contacts of each pair. Each fuel injector has seals that seal to the upper and lower housing parts. Where the input connector of each connector assembly extends perpendicular to the rest of the connector assembly, a flexible circuit board may be provided which is held in its final bent position by the upper and lower housing parts. In a situation where the fuel injectors extend at angles from the direction of elongation of most of the connector assembly, the lower housing part is provided with similarly angled faces. A face seal is provided at each fuel injector-connecting location of the lower housing part The face seal has a cross section with a greater height than its width and with a bulging inner portion The contacts on the circuit board each includes a flange lying facewise against a conductive pad on the circuit board, a base extending through the circuit board, and a plurality of fingers extending up from the circuit board Although particular embodiments of the invention have been described and illustrated herein, it is recognized that modifications and variations may readily occur to those skilled in the art and consequently it is intended to cover such modifications and equivalents.

What is claimed is:

1. Apparatus for use with an engine having power cylinders, a fuel injector rail for carrying pressured liquid fuel, a plurality of fuel injectors each mounted on said rail and coupled to one of said power cylinders to supply fuel from the rail thereto with each fuel injector controlled by an electrical signal, and a circuit for generating said signals, for coupling said circuit to said injectors, comprising:

an elongated assembly which includes a printed circuit board with opposite faces and a housing comprising upper and lower parts lying on opposite faces of said circuit board and trapping said circuit board between them to form an elongated sandwiched connector assembly, said connector assembly having an input connector end portion with an input connector and having an elongated output portion with a plurality of injector-connecting locations spaced therealong, said housing parts trapping said circuit board between them at both said input end portion and said output portion;

said circuit board having a pair of connector assembly contacts at each of said injector-connecting locations, said circuit board having a plurality of connector terminals at said input connector including a bus connector terminal and a plurality of signal terminals, said circuit board having a bus conductor connecting said bus terminal to one contact of each of said pairs of contacts, and having a plurality of signal circuit conductors connecting selected ones of said signal connector terminals to another contact of each of said pairs of contacts to supply electrical signals received on one of said terminals to an injector at a corresponding one of said injector-connecting locations;

said output portion of said connector assembly extending substantially in a straight line and said input connector end portion extending primarily perpendicular to said output portion;

said circuit board being flexible in bending and said upper and lower housing parts being substantially rigid molded parts and hold said circuit board to extend substantially straight along said input and output portions and in a largely 90° bend at the intersection of said input and output portions.

2. Apparatus for use with an engine having power cylinders, a fuel injector rail for carrying pressured liquid fuel, a plurality of fuel injectors each mounted on said rail and coupled to one of said power cylinders to supply fuel from the rail thereto with each fuel injector controlled by an electrical signal, and a circuit for generating said signals, for coupling said circuit to said injectors, comprising:

an elongated assembly which includes a printed circuit board with opposite faces and a housing comprising upper and lower parts lying on opposite faces of said circuit board and trapping said circuit board between them, to form an elongated sandwiched connector assembly, said connector assembly having an input connector end portion with an input connector and having an elongated output portion with a plurality of injector-connecting locations spaced therealong;

said circuit board having a pair of connector assembly contacts at each of said injector-connecting locations, said circuit board having a plurality of connector terminals at said input connector including a bus connector terminal and a plurality of signal terminals, said circuit board having a bus conductor connecting said bus terminal to one contact of each of said pairs of contacts, and having a plurality of signal circuit conductors connecting selected ones of said signal connector terminals to another contact of each of said pairs of contacts to supply electrical signals received on one of said terminals to an injector at a corresponding one of said injector-connecting locations;

said lower housing part and said circuit board each have aligned holes at each of said injector-connecting locations;

each of said fuel injectors includes an inner projection that projects through said aligned holes; and including:

a first seal (94) that seals a portion of said lower housing that extends around each pair of aligned holes to a corresponding fuel injector;

a second seal (96) that seals said inner projection of each fuel injector to said upper housing part;

each of said pairs of said circuit board connector assembly contacts (70, 72) lying between said first and second seals.

3. Apparatus for use with an engine having power cylinders, a fuel injector rail for carrying pressured liquid fuel, a plurality of fuel injectors each mounted on said rail and coupled to one of said power cylinders to supply fuel from the rail thereto with each fuel injector controlled by an electrical signal, and a circuit for generating said signals, and wherein said fuel injectors are spaced apart along a first direction but each has an axis that extends at an angle G to said first direction, wherein said apparatus is useful to couple said circuit to said injectors, comprising:

an elongated assembly which includes a printed circuit board with opposite faces and a housing comprising upper and lower parts lying on opposite faces of said circuit board and trapping said circuit board between them, to form an elongated sandwiched connector assembly, said connector assembly having an input connector end portion with an input connector and having an elongated output portion with a plurality of injector-connecting locations spaced therealong;

said circuit board having a pair of connector assembly contacts at each of said injector-connecting locations, said circuit board having a plurality of connector terminals and a plurality of signal terminals, said circuit board having a bus conductor connecting said bus terminal to one contact of each of said pairs of contacts, and having a plurality of signal circuit conductors connecting selected ones of said signal connector terminals to another contact of each of said pairs of contacts to supply electrical signals received on one of said terminals to an injector at a corresponding one of said injector-connecting locations;

said injector-connecting locations are spaced along said first direction (146) and said lower housing part has a face at each of said injector-connecting locations that extends perpendicular to said axis and at an angle G to said first direction.

4. The apparatus described in claim 3 wherein:

each of said circuit board connector assembly contacts comprises a sheet metal contact mounted on said circuit board with a flange lying facewise against a face of said board, and a pair of fingers with inner ends extending largely perpendicular to said face of said board through a hole in said board and out of said hole, and with outer ends extending toward each other and back towards said flange.

5. Apparatus for use with an engine having power cylinders, a fuel injector rail for carrying pressured liquid fuel, a plurality of fuel injectors each mounted on said rail and coupled to one of said power cylinders to supply fuel from the rail thereto with each fuel injector controlled by an electrical signal, and a circuit for generating said signals, for coupling said circuit to said injectors, comprising:

an elongated assembly which includes a printed circuit board with opposite faces and a housing comprising upper and lower parts lying on opposite faces of said circuit board and trapping said circuit board between them, to form an elongated sandwiched connector assembly, said connector assembly having an input connector end portion with an input connector and having an elongated output portion with a plurality of injector-connecting locations spaced therealong;

said circuit board having a pair of connector assembly contacts at each of said injector-connecting locations, said circuit board having a plurality of connector terminals at said input connector including a bus connector terminal and a plurality of signal terminals, said circuit board having a bus conductor connecting said bus terminal to one contact of each of said pairs of contacts, and having a plurality of signal circuit conductors connecting selected ones of said signal connector terminals to another contact of each of said pairs of contacts to supply electrical signals received on one of said terminals to an injector at a corresponding one of said injector-connecting locations;

said injector-connecting locations of said connector assembly each has a largely flat face with a circular groove therein, and an elastomeric ring seal lying in said groove for sealing to a fuel injector, said groove having a cross-section with a width and a height;

said seal having a greater height than width, said height being great enough that said seal has an outer part that projects form said groove, said seal having an inner part with sidewardly protruding sides in an interference fit with said groove, whereby to securely retain said seal before a fuel injector is installed.

6. The apparatus described in claim 5 wherein:

said seal is of a largely hourglass shape, with said inner and outer portions each being rounded and with a necked region of smaller diameter than said inner and outer portions lying between them.

* * * * *